US007748231B2

(12) United States Patent
Chung

(10) Patent No.: US 7,748,231 B2
(45) Date of Patent: Jul. 6, 2010

(54) ICE-CUBE COMPLETE FILLING DETECTOR AND REFRIGERATOR COMPRISING THE SAME

(75) Inventor: Sung Hoon Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 958 days.

(21) Appl. No.: 11/356,161

(22) Filed: Feb. 17, 2006

(65) Prior Publication Data

US 2007/0103940 A1 May 10, 2007

(30) Foreign Application Priority Data

Nov. 10, 2005 (KR) ..... 10-2005-0107693

(51) Int. Cl.
*F25C 5/18* (2006.01)

(52) U.S. Cl. ..... 62/344; 62/137; 62/340; 74/439; 477/15; 477/16; 477/20

(58) Field of Classification Search ..... 62/137, 62/340, 344; 74/439; 477/15, 16, 20
See application file for complete search history.

(56) References Cited

U.S. PATENT DOCUMENTS 3,529,430 A * 9/1970 Bauerlein ..... 62/137
6,148,624 A * 11/2000 Bishop et al. ..... 62/137
6,857,279 B2 * 2/2005 Kim et al. ..... 62/135

* cited by examiner

*Primary Examiner*—Frantz F Jules
*Assistant Examiner*—Azim Rahim
(74) *Attorney, Agent, or Firm*—Birch, Stewart, Kolasch & Birch, LLP

(57) ABSTRACT

An ice-cube complete filling detector and a refrigerator comprising the same comprise a cam, an arm lever rotated by the cam, a detector driving gear rotated by the arm lever, a detector driven gear rotated by the detector driving gear, and an ice-cube detection lever connected to the detector driven gear, so that the detector driven gear is rotated via gear engagement by the detector driving gear and the detector driven gear, and the ice-cube detection lever can be rotated in a large range of about 180 degrees, thereby ensuring high accuracy of detection.

6 Claims, 11 Drawing Sheets

ICE-CUBE COMPLETE FILLING DETECTOR AND REFRIGERATOR COMPRISING THE SAME

BACKGROUND OF THE INVENTION

1. Field of the Invention

The present invention relates to an ice-cube complete filling detector, and a refrigerator comprising the same. More particularly, the present invention relates to an ice-cube complete filling detector for an icemaker, which can increase a rotational angle of an ice-cube detection lever or lower a rotational center of the ice-cub detection lever so as to effectively detect a complete filling state of an ice-cube container containing ice cubes.

2. Description of the Related Art

FIG. 1 is a perspective view illustrating a typical refrigerator in which doors for freezing and refrigerating compartments are open.

Generally, as shown in FIG. 1, the refrigerator includes a body 2 which comprises a freezing compartment F and a refrigerating compartment R partitioned by a barrier 1, and has a cooling cycle arrangement equipped therein to cool the freezing compartment F and the refrigerating compartment R. The freezing compartment F and the refrigerating compartment R are open and/or closed by a freezing compartment door 4, and a refrigerating compartment door 6, both of which are connected to the body 2.

The cooling cycle arrangement comprises a compressor to compress a refrigerant of low temperature and low pressure to the refrigerant of high temperature and high pressure, and to discharge the refrigerant, a condenser to condense the refrigerant discharged from the compressor such that heat of the refrigerant is emitted to external air, an expansion unit to expand the refrigerant condensed through the condenser, and an evaporator to evaporate the expanded refrigerant with heat of air circulating from the freezing compartment F or the refrigerating compartment R.

Recently, the refrigerator further comprises an automatic ice making apparatus which produces ice cubes using cold air in the freezing compartment F, and dispenses the ice cubes to an outside thereof.

The automatic ice making apparatus includes an icemaker 8 positioned at an upper portion of the freezing compartment F to automatically freeze supplied water into ice cubes with cold air in the freezing compartment F, and an ice-cube container 9 disposed below the icemaker 8 within the freezing compartment F to contain the ice cubes separated from the icemaker 8, an ice-cube discharger 10 positioned in the freezing compartment door 4 such that the ice cubes can be taken from the ice-cube container 9 to the outside without opening the freezing compartment door 4, and an ice-cube chute 11 to guide the ice cubes from the ice-cube container 9 into the ice-cube discharger 10.

FIG. 2 is a perspective view illustrating conventional icemaker and ice-cube container, and FIG. 3 is a diagram illustrating an inner configuration of a controller for the conventional icemaker.

The icemaker 8 comprises an ice making tray 12 to contain water supplied thereto and then freeze the water into ice cubes I of a predetermined shape, a water feeding port 13 to feed water into the ice making tray 12, a heater to heat the ice making tray 12 in order to separate the ice cubes I from the ice making tray 12, a slider 14 provided therein to allow the ice cubes I separated from the ice making tray 12 to slide into the ice-cube container 9, an ejector 15 to scoop the ice cubes I from the ice making tray 12 to the slider 14, a controller to control operation of the heater, the ejector 15, etc., and a detector to detect whether the ice-cube container 9 is completely filled with the ice cubes I, which will hereinafter referred to as an "ice-cube complete filling detector."

The ice making tray 12 has a substantially semi-cylindrical shape, and is formed therein with partitions 12*b* separated a predetermined distance from each other to allow the ice cubes I to be independently taken out therefrom.

The ejector 15 has a shaft 15*a* positioned along the center of the ice making tray 12, and a plurality of ejector pins 15*b* positioned at a lateral side of the shaft 15*a* to scoop the ice cubes I to the slider 14.

The controller 16 comprises a control panel 21 having various electronic components mounted thereon, a motor 24, a driving gear 25 connected to a shaft of the motor 24, and a driven gear 26 engaging with the driving gear 25 while being connected at a rotational shaft 26*a* thereof to the shaft 15*a* of the ejector 15.

The ice-cube complete filling detector comprises a cam 27 protruding from the rotational shaft 26*a* of the driven gear 26, a first arm lever 28 interlocked to the cam 27 to rotate, a second arm lever 29 slidably connected to the first arm lever 28, an ice-cube detection lever 30 connected to the second arm lever 28, a magnet 31 rotated synchronously with rotation of the second arm lever 28, and a hole-sensor 32 to detect a magnetic field of the magnet 31.

The ice-cube detection lever 30 has opposite ends rotatably coupled to opposite sides of the icemaker 8, and is bent outwardly from the icemaker 8.

The magnet 31 is positioned on an extension 30*a* of the ice-cube detection lever 30.

Detection for complete filling of the ice-cube container 9 with the ice cubes I is performed by the hole-sensor 32, which detects a magnetic field generated when a rotating position of the magnet 31 changes due to rotation of the ice-cube detection lever 30.

However, with the conventional ice-cube complete filling detector, when the ice cubes I are vertically stacked on a wall of the ice-cube container 9 for the reason, for example, that the ice-cube container 9 has a shallow volume, the ice-cube detection lever 30 is rotated in the range of about 90 degrees by the arm levers 1 and 2, and cannot detect the complete filling of the ice-cube container 9 with the ice cubes I, so that the ice cubes are continuously supplied to, and overflows the ice-cube container 9.

SUMMARY OF THE INVENTION

The present invention has been made to solve the above problems, and it is an object of the present invention to provide an ice-cube complete filling detector and a refrigerator comprising the same, which allow an ice-cube detection lever to have an increased rotational range, thereby enhancing accuracy in detection of a complete filling state of an ice-cube container containing ice cubes.

It is another object of the present invention to provide the ice-cube complete filling detector and the refrigerator comprising the same, which lower a height to determine the complete filling of the container with the ice cubes without changing the length of the ice-cube detection lever so that, when the ice cubes are stacked on a wall within the ice-cube container, the complete filling state of the ice-cube container is detected without errors.

In accordance with one aspect of the present invention, the above and other objects can be accomplished by the provision of an ice-cube complete filling detector, comprising: a cam; an arm lever rotated by the cam; a detector driving gear rotated by the arm lever; a detector driven gear rotated by the detector driving gear; an ice-cube detection lever connected to the detector driven gear; and a sensing unit to detect rotation of one of the arm lever, the detector driving gear and the ice-cube detection lever.

Preferably, the detector driving gear comprises an arm lever-engaging portion engaging with teeth of the arm lever, and a detector driven gear-engaging portion engaging with teeth of the detector driven gear.

Preferably, the arm lever-engaging portion and the detector driven gear-engaging portion have sector shapes, respectively, and are opposite to each other with respect to a rotational center.

Preferably, the detector driven gear-engaging portion is greater than the arm lever-engaging portion, and has more teeth than the arm lever-engaging portion.

Preferably, the detector driven gear has teeth formed along an outer periphery thereof.

Preferably, the sensing unit comprises a magnet provided to the arm lever, and a hole-sensor provided to the icemaker.

In accordance with another aspect of the present invention, an ice-cube complete filling detector comprises a cam; an arm lever rotated by the cam; a detector driving gear rotated by the arm lever; a detector driven gear connected to an ice-cube detection lever; a height adjusting unit interlocked to the detector driving gear to rotate the detector driven gear while lowering the detector driven gear; and a sensing unit to detect rotation of one of the arm lever, the detector driving gear and the detector driven gear.

Preferably, the detector driving gear comprises an arm lever-engaging portion engaging with teeth of the arm lever, and a detector driven gear-engaging portion engaging with teeth of the detector driven gear.

Preferably, the arm lever-engaging portion and the detector driven gear-engaging portion have sector shapes, respectively, and are opposite to each other with respect to a rotational center.

Preferably, the detector driven gear-engaging portion is greater than the arm lever-engaging portion, and has more teeth than the arm lever-engaging portion.

Preferably, the detector driven gear has teeth formed along an outer periphery thereof.

Preferably, the detector driven gear has a rotational center located lower than a lower end of an ice making space of an ice making tray.

Preferably, the height adjusting unit is an intermediate gear assembly engaging with the detector driving gear and the detector driven gear.

Preferably, the intermediate gear assembly is rotatably supported on the detector driven gear.

Preferably, the intermediate gear assembly comprises a plurality of gears sequentially engaging with each other between the detector driving gear and the detector driven gear.

Preferably, the sensing unit comprises a magnet provided to the arm lever, and a hole-sensor provided to the icemaker.

In accordance with yet another aspect of the present invention, a refrigerator comprises a body comprising a containing compartment and a cooling cycle arrangement to supply cold air into the containing compartment; a door to open or close the containing compartment; an icemaker positioned in the door; an ice-cube container positioned in the door to contain ice cubes separated from the icemaker; an ice-cube discharger positioned in the door to allow the ice cubes to be taken from the ice-cube container; a motor positioned in the icemaker; a driving gear connected to the motor; a driven gear rotated by the driving gear; a cam connected to one of a rotational shaft of the driving gear and a rotational shaft of the driving gear; an arm lever rotated by the cam; a detector driving gear rotated by the arm lever; a detector driven gear rotated by the detector driving gear; an ice-cube detection lever connected to the detector driven gear; and a sensing unit to detect rotation of one of the arm lever, the detector driving gear and the ice-cube detection lever.

Preferably, the detector driving gear comprises an arm lever-engaging portion engaging with teeth of the arm lever, and a detector driven gear-engaging portion engaging with teeth of the detector driven gear.

Preferably, the detector driven gear has teeth formed along an outer periphery thereof.

Preferably, the ice-cube complete filling detector further comprises an intermediate gear assembly positioned between the detector driving gear and the detector driven gear to lower the detector driven gear.

According to the present invention, the ice-cube complete filling detector and the refrigerator comprising the same comprise the detector driving gear rotated by the arm lever; the detector driven gear rotated by the detector driving gear; and the ice-cube detection lever connected to the detector driven gear, so that the detector driven gear is rotated via gear engagement by the detector driving gear and the detector driven gear, and the ice-cube detection lever can be rotated in a large range of about 180 degrees, thereby ensuring high accuracy of detection.

According to the present invention, the ice-cube complete filling detector and the refrigerator comprising the same comprise the detector driving gear rotated by the arm lever; the detector driven gear connected to the ice-cube detection lever; and the height adjusting unit interlocked to the detector driving gear to rotate the detector driven gear while lowering the detector driven gear; so that a height to determine a complete filling state of the ice-cube container containing the ice cubes is lowered without changing the length of the ice-cube detection lever, thereby minimizing errors in detection of the complete filling state of the ice-cube container containing the ice cubes, which can occur when the ice-cube container has a deep volume, and the ice cubes are vertically stacked along the wall within the container.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings.

Figure 1:
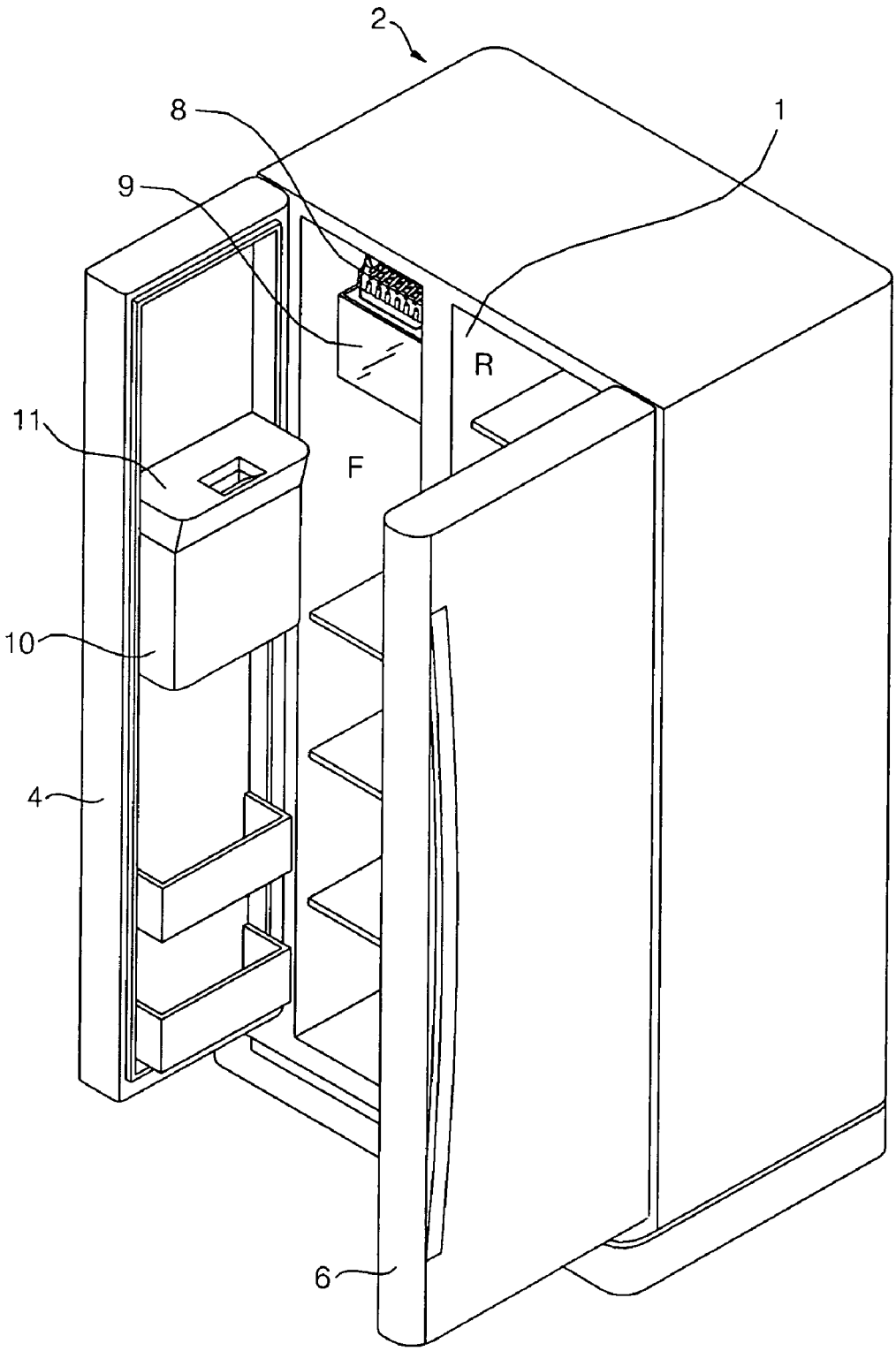
FIG. 1 (related art)
FIG. 1 is a perspective view of a typical refrigerator in which doors for freezing and refrigerating compartments are open.
Figure 2:
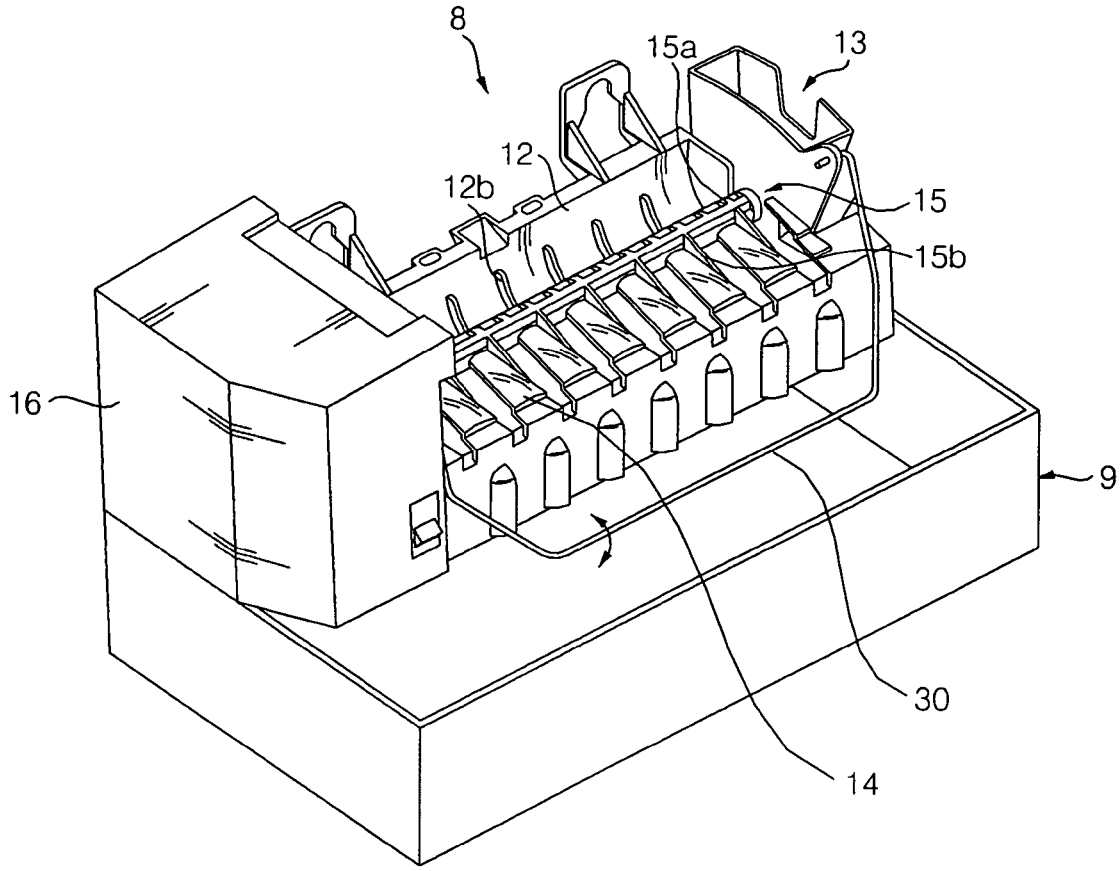
FIG. 2 (related art)
FIG. 2 is a perspective view of a conventional icemaker and ice-cube container.
Figure 3:
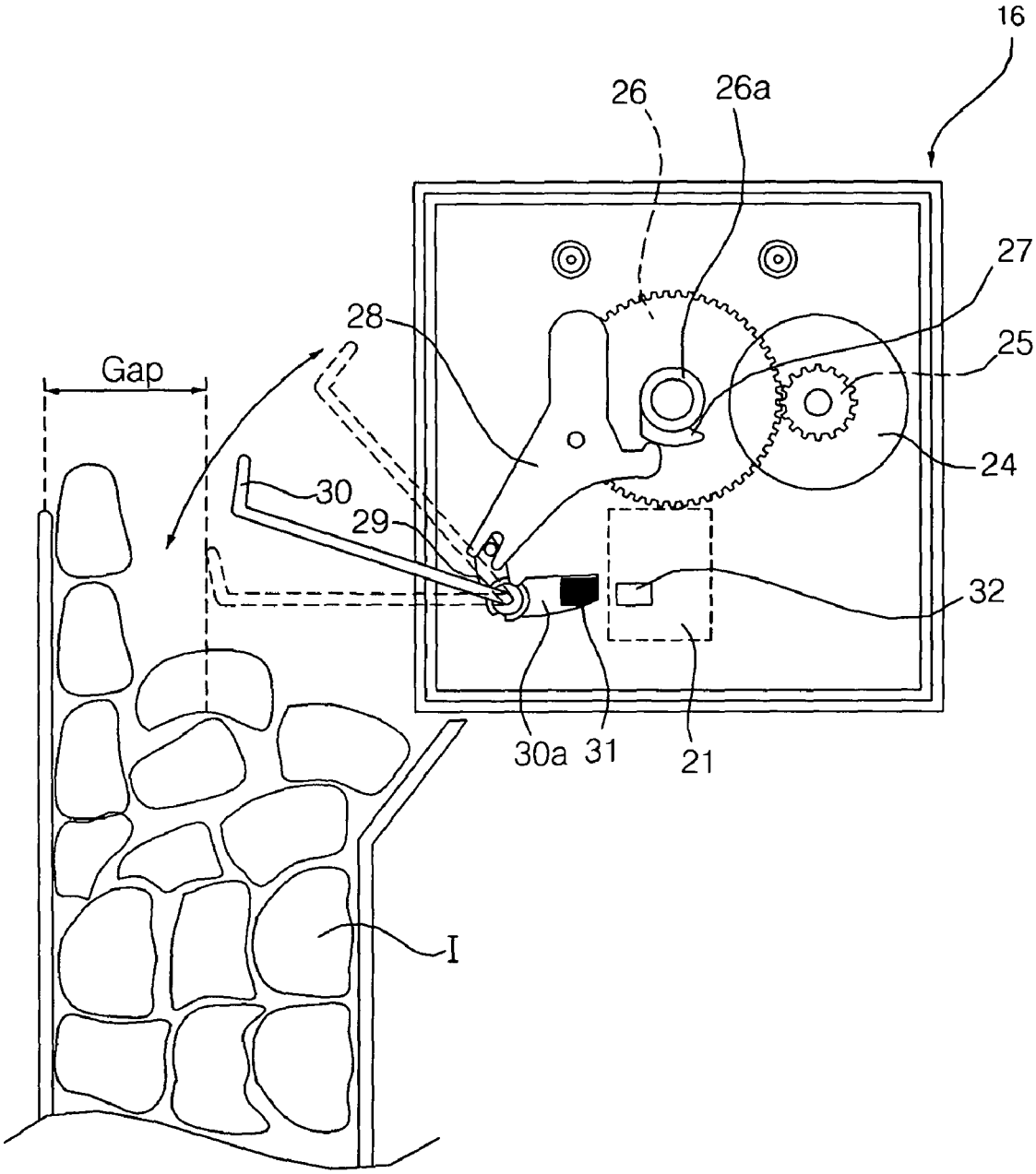
FIG. 3 (related art)
FIG. 3 is a diagram of an inner configuration of a controller for the conventional icemaker.
Figure 4:
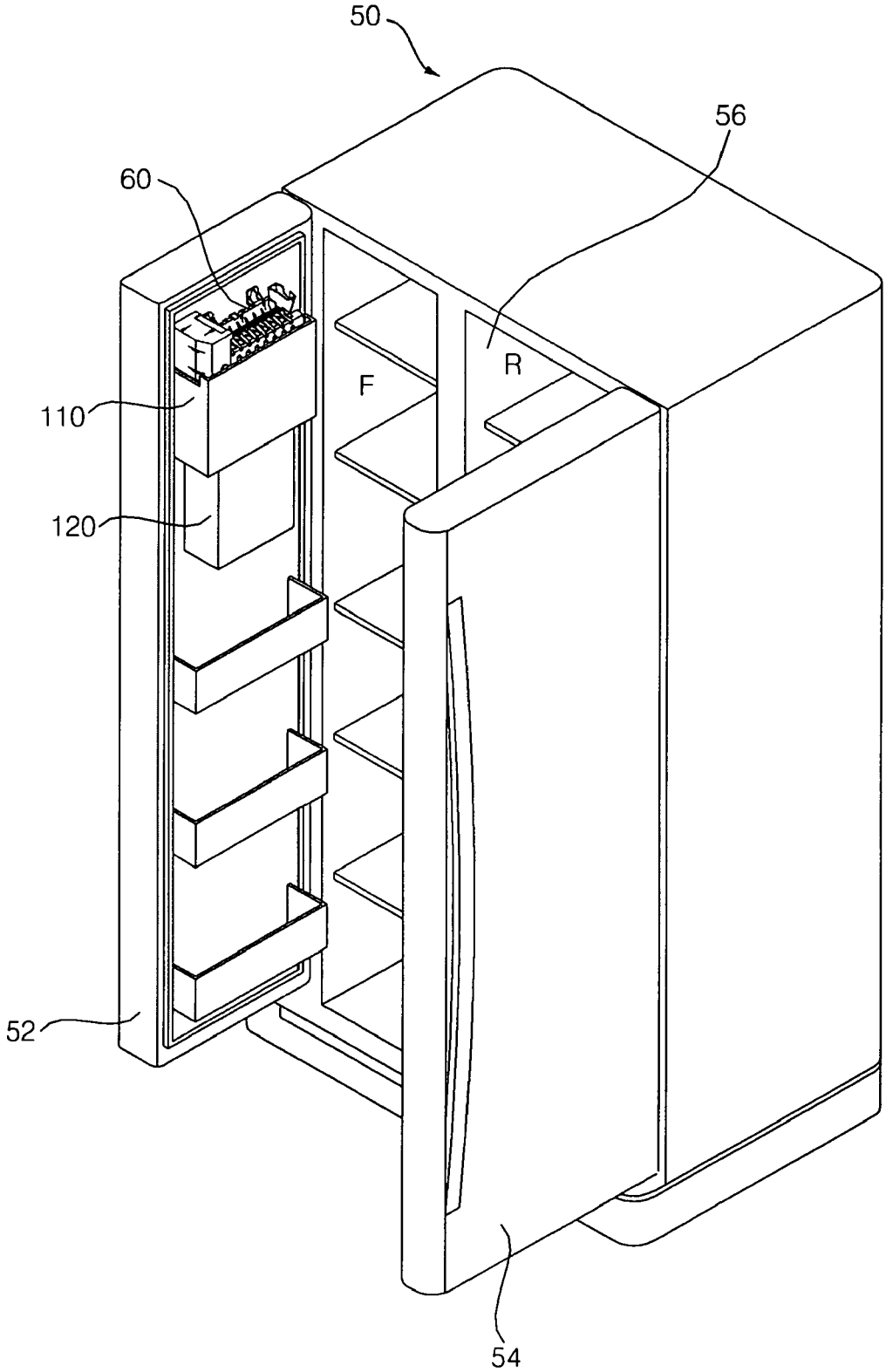
FIG. 4 is a perspective view schematically illustrating a refrigerator comprising an ice-cube complete filling detector in accordance with a first embodiment of the present invention.

FIG. 4 is a perspective view schematically illustrating a refrigerator comprising an ice-cube complete filling detector in accordance with a first embodiment of the present invention.

Referring to FIG. 4, the refrigerator includes a body 50, which comprises a freezing compartment F and a refrigerating compartment R, and has a cooling cycle arrangement equipped therein to supply cold air into the freezing compartment F and the refrigerating compartment R, and doors 52 and 54 to open or close the freezing compartment F and the refrigerating compartment R, respectively.

The body 50 is partitioned into the freezing compartment F and the refrigerating compartment R by a barrier 56.

The cooling cycle arrangement comprises a compressor to compress a refrigerant of low temperature and low pressure to the refrigerant of high temperature and high pressure, and to discharge the refrigerant, a condenser to condense the refrigerant discharged from the compressor such that heat of the refrigerant is emitted to external air, an expansion unit to expand the refrigerant condensed through the condenser, and an evaporator to evaporate the expanded refrigerant with heat of air circulating from the freezing compartment F or the refrigerating compartment R.

The doors 52 and 54 are a freezing compartment door 52, and a refrigerating compartment door 54, which are connected to the body 2 to open or close the freezing and refrigerating compartments F and R, respectively.

The freezing compartment door 52 is provided with an icemaker 60 to freeze water into ice cubes with cold air in the freezing compartment F, and an ice-cube container 110 to contain the ice cubes separated from the icemaker 60.

The icemaker 60 and the ice-cube container 110 are mounted on a rear side of the freezing compartment door 52 in order to increase an effective inner volume of the freezing compartment F.

The freezing compartment door 52 is further provided with an ice-cube discharger 120 to allow the ice cubes to be taken from the ice-cube container to the outside without opening the freezing compartment door 52.

Figure 5:
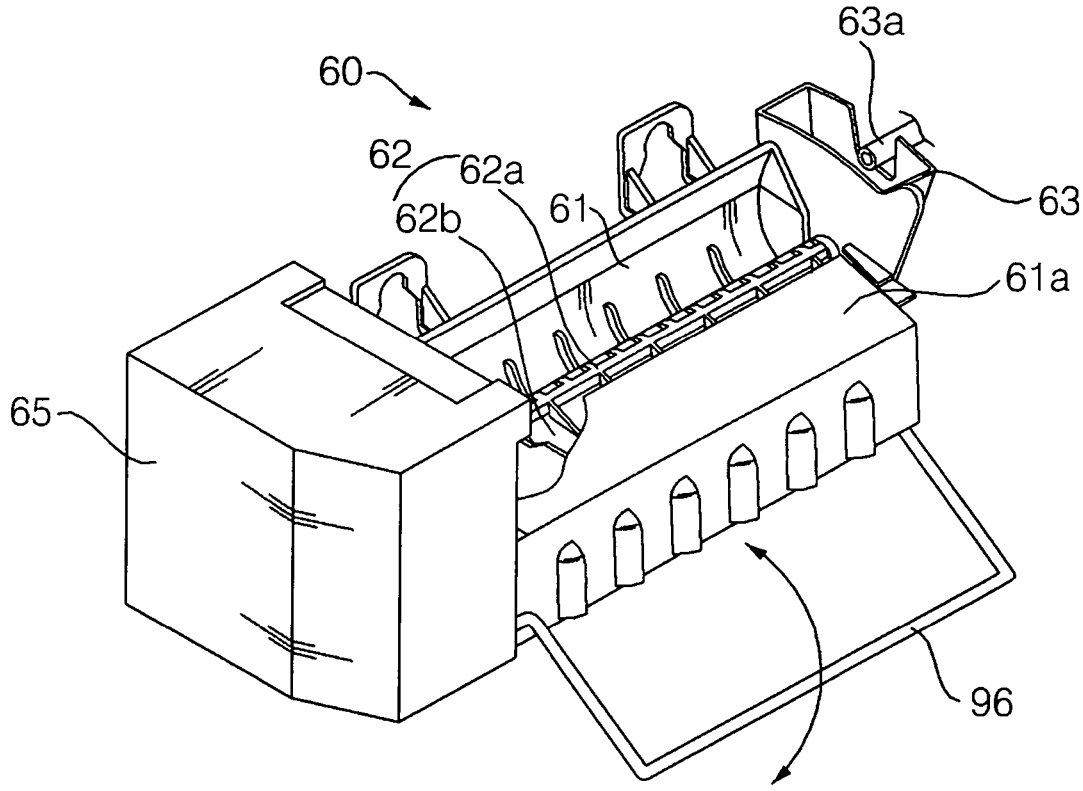
FIG. 5 is a perspective view of a schematic configuration of an icemaker shown in FIG. 4.

FIG. 5 is a perspective view of a schematic configuration of an icemaker shown in FIG. 4.

As shown in FIG. 5, the icemaker 60 comprises an ice making tray 12 having an ice making space open at an upper portion to contain water supplied to the ice making space and then freeze the water into ice cubes, an ejector 62 to scoop up and separate the ice cubes from the ice making space, a cup 63 to contain water supplied from a water feeding hose 63*a* while supplying the water into the ice making space of the ice making tray 61, a heater 64 (not shown) to heat the ice making tray 61 in order to separate the ice cubes from the ice making tray 61, and a controller 65 to control operation of the icemaker 60.

The ice making tray 61 is provided with a slider 61*a* to guide the ice cubes I scooped by the ejector 62 to the ice-cube container 110.

Figure 6:
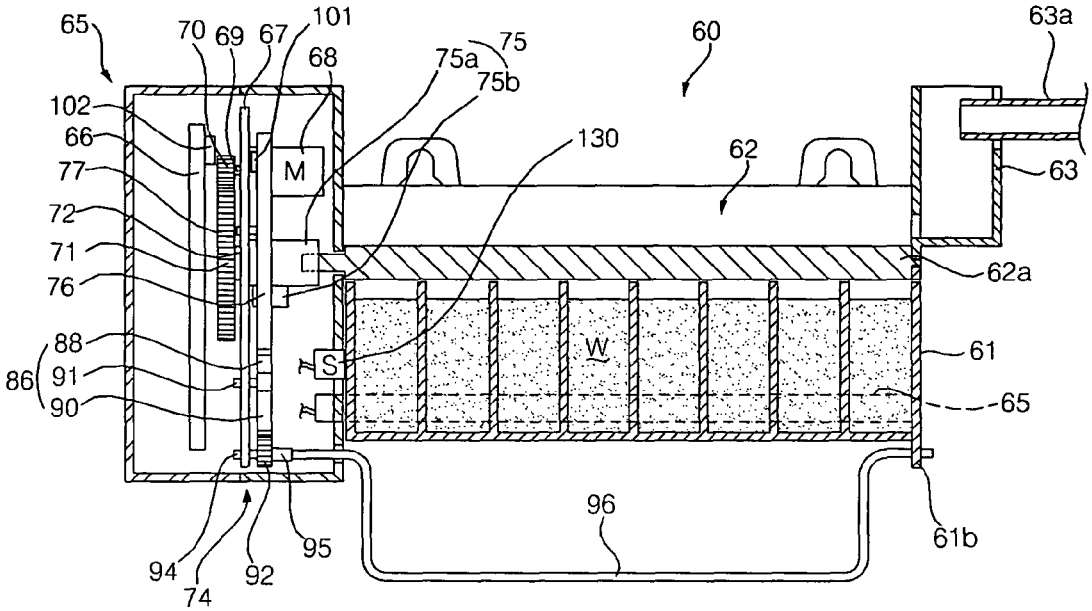
FIG. 6 is a partially cut-away cross-sectional view of the icemaker of FIG. 4.

As shown in FIG. 6, the ejector 62 comprises a shaft 62*a* traversing an upper portion of the ice making space, and a plurality of ejector pins 15*b* protruding from a side surface of the shaft 62*a*.

The shaft 62*a* has one end rotatably supported by the cup 63, and the other end penetrating into the controller 65.

Figure 7:
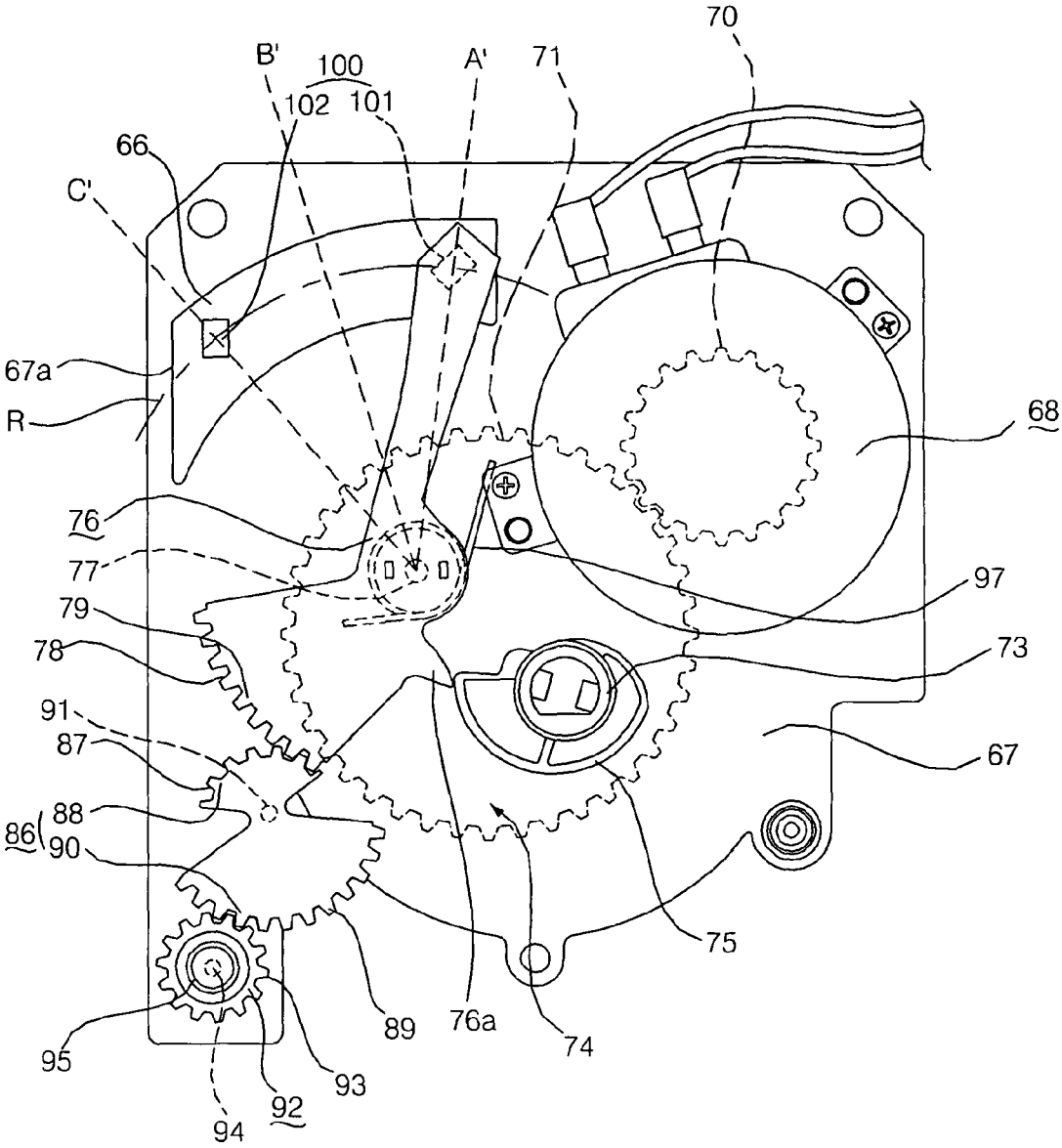
FIG. 7 is a side view of the ice-cube complete filling detector in accordance with the first embodiment before operation thereof.
Figure 8:
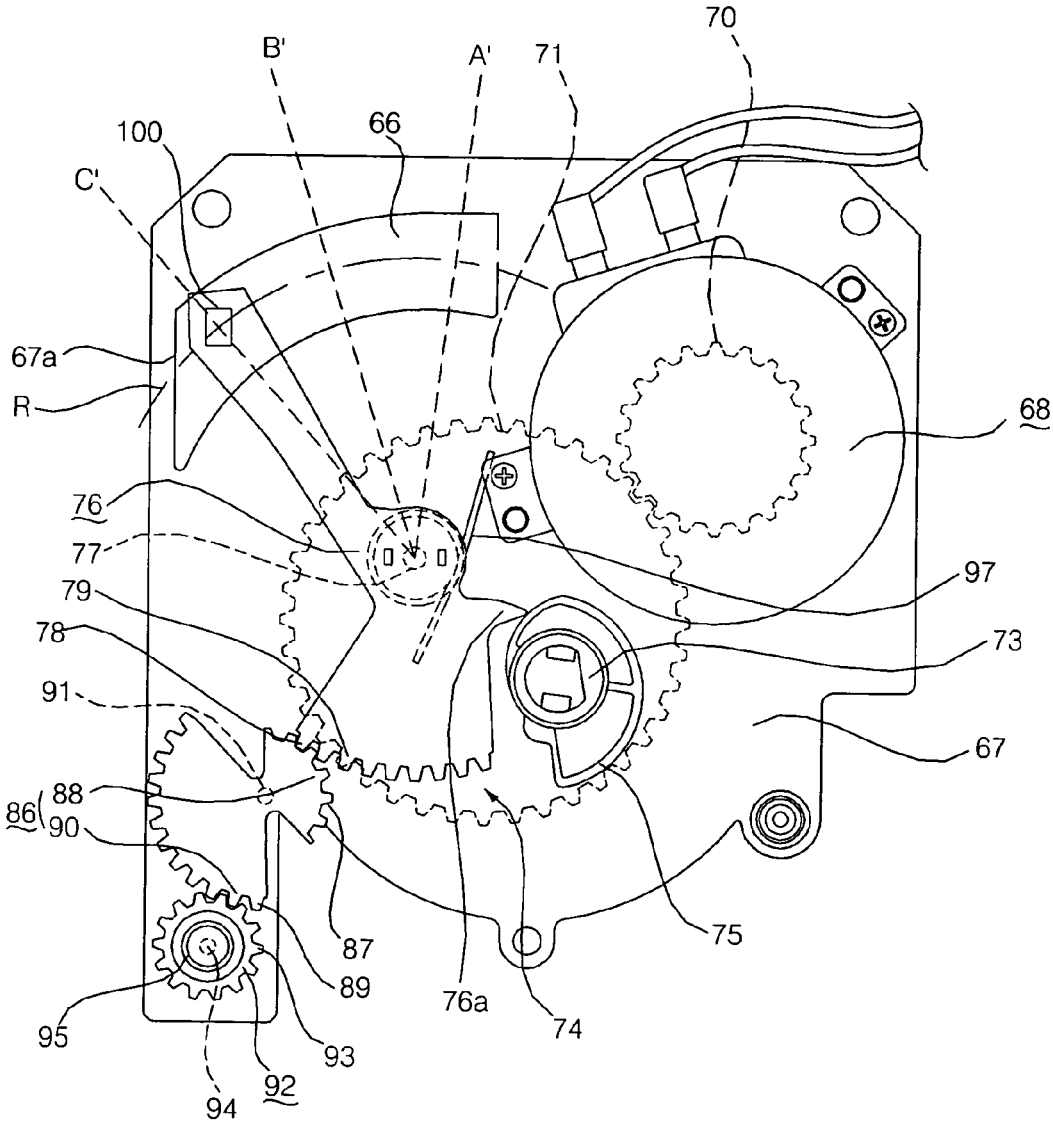
FIG. 8 is a side view of the ice-cube complete filling detector in accordance with the first embodiment upon operation thereof.
Figure 9:
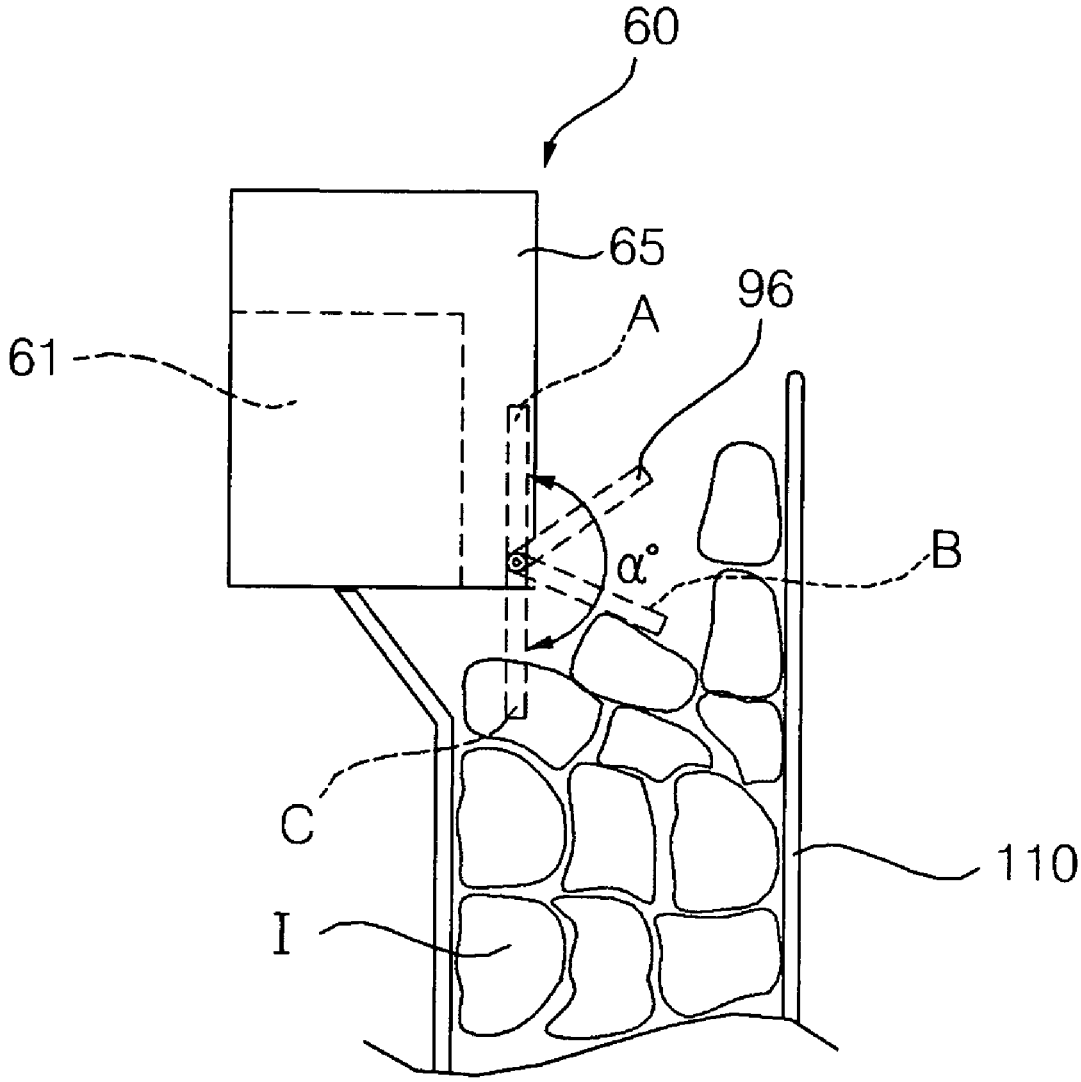
FIG. 9 is a schematic view of the icemaker and an ice-cube container shown in FIG. 4.

FIG. 6 is a partially cut-away cross-sectional view of the icemaker of FIG. 4, FIG. 7 is a side view of the ice-cube complete filling detector in accordance with the first embodiment before operation thereof, FIG. 8 is a side view of the ice-cube complete filling detector in accordance with the first embodiment upon operation thereof, and FIG. 9 is a schematic view of the icemaker and an ice-cube container shown in FIG. 4.

As shown in FIG. 6, the controller 65 is provided therein with a control panel 66 having various electronic components mounted thereon to control the icemaker 60, and a plate 67 on which a motor, and other components (described below) are mounted.

As shown in FIGS. 6 to 8, a motor 68 is mounted on the plate 67, and generates driving force for rotation of the ejector 62 and detection of a complete filling state of the ice-cube container 110 containing the ice cubes.

The motor 68 has a rotational shaft 69 penetrating the plate 67.

The rotational shaft 69 of the motor 68 is connected with a driving gear 70.

The driving gear 70 engages with a driven gear 71.

The driven gear 71 has a rotational shaft 72 penetrating the plate 67.

Meanwhile, as shown in FIGS. 6 to 8, the controller 65 has an ice-cube complete filling detector 74 which detects the complete filling state of the ice-cube container 110 containing the ice cubes.

The ice-cube complete filling detector 74 is interlocked to one of the driving gear 70 and the driven gear 71. Herein, the ice-cube complete filling detector 74 will be described as being interlocked to the driven gear 71.

The ice-cube complete filling detector 74 comprises a cam 75, an arm lever 76 rotated by the cam 75, a detector driving gear 86 rotated by the arm lever 76, a detector driven gear 92 rotated by the detector driving gear 86, and an ice-cube detection lever 96 connected to the detector driven gear 92.

The cam 75 comprises a shaft 75*a* connected to a rotational shaft 72 of the driven gear 71, and a nose 75*b* partially formed on an outer periphery of the shaft 75*a*.

One end of the shaft 62*a* of the ejector 62 is fitted into the shaft 75*a* of the cam 75.

The nose 75*b* of the cam 75 is gradually raised along the outer periphery of the shaft 75*a*, and is then rapidly lowered.

The arm lever 76 is located in front of the motor 68 and the cam 75, and has a rotational joint 77 penetrating the plate 67 such that the arm lever 76 is rotatably supported by the plate 67.

The arm lever 76 has an elongated height, and is formed with a detector driving gear-engaging portion 79 of a sector shape around a lower portion of the arm lever 76 such that the detector driving gear-engaging portion 79 is located lower than the rotational joint 77. The detector driving gear-engaging portion 79 has teeth 78 which engage with teeth 87 of the detector driving gear 86.

The arm lever 76 is formed with a protrusion 76*a* which contacts the cam 75 such that the arm lever 76 is rotated by the cam 75.

The detector driving gear 86 comprises an arm lever-engaging portion 88 which has teeth 87 engaging with the teeth 78 of the arm lever 76, and a detector driven gear-engaging portion 90 which has teeth 89 engaging with teeth 93 of the detector driven gear 92.

The detector driven gear 92 has a rotational joint 91 penetrating the plate 67 such that the detector driven gear 92 is rotatably supported by the plate 67.

On the detector driving gear 86, the arm lever-engaging portion 88 and the detector driven gear-engaging portion 90 have sector shapes, respectively, and are opposite to each other with respect to the rotational joint 91.

The arm lever-engaging portion 88 and the detector driven gear-engaging portion 90 are preferably formed with the teeth as much as possible in order to allow the detection lever 96 to have a rotational range (α degrees) approaching 180 degrees as shown in FIG. 9.

The detector driven gear-engaging portion 90 is greater than the arm lever-engaging portion 88, and has more teeth 89 than the arm lever-engaging portion 88.

The number of teeth 89 of the detector driven gear-engaging portion 90 is equal or similar to the number of teeth 93 of the detector driven gear 92.

The teeth 93 of the detector driven gear 92 are formed along the entire outer periphery thereof.

The detector driven gear 92 has a rotational joint 94 penetrating the plate 67 such that detector driven gear 92 is rotatably supported by the plate 67.

The detector driven gear 92 has a lever inserting portion 95 protruding therefrom, to which one end of the detection lever 96 is fitted.

The detection lever 96 has a length not interfering with a wall of the ice-cube container 110 during rotation of the detection lever 96.

The detection lever 96 substantially has a U-shape, one end of which penetrates the controller 65 and is then fitted into the lever inserting portion 95, and the other end of which is rotatably supported by a lever supporting portion 61*b* formed at a lower portion of one of the ice making tray 61 and the slider 61*a*.

The ice-cube complete filling detector 74 further comprises a sensing unit 100 which detects rotation of one of the arm lever 76, the detector driving gear 86, and the detector driven gear 92.

The sensing unit 100 comprises a magnet 101, and a hole-sensor 102, which detects variation in magnetic field according to variation in distance with respect to the magnet 101 and outputs a pulse to the control panel 66.

To ensure easy installation of the magnet 101, the sensing unit 100 is limited in its function to detect a rotational position of the arm lever 76.

The magnet 101 is installed higher than the rotational joint 77 of the arm lever 76.

The hole-sensor 102 is mounted on the control panel 66 while being located at one side of a migratory trajectory R of the magnet 81 according to the rotation of the arm lever 76.

The ice-cube complete filling detector 74 further comprises a spring 106 to apply an elastic force to the arm lever 76.

The spring 106 is compressed, as shown in FIG. 7, when the cam 75 pushes down the protrusion 76*a* of the arm lever 76. Then, when the cam 75 does not push down the protrusion 76*a*, the spring 106 is stretched, and rotates the arm lever 76 in an approaching direction of the hole-sensor to the magnet, as shown in FIG. 8. Most preferably, the spring 106 is constituted by a torsion spring.

The spring 106 has one end latched to a latching protrusion (not shown) formed on the plate 67, and the other end latched to a latching protrusion (not shown) formed on the arm lever 76.

In FIG. 6, reference numeral 130 indicates a temperature sensor to detect the temperature of the ice making tray 61.

In FIGS. 7 and 8, reference numeral 67*a* indicates an opening formed corresponding to the migratory trajectory R of the magnet 101 such that the plate 67 does not obstruct the hole-sensor 102 from detecting the magnetic field.

Operation of the ice-cube complete filling detector 74 of the present invention constructed as described above will be described as follows.

First, after allowing the water feeding valve serving to regulate a supply of water into the cup 63 to be open for a predetermined period of time, the control panel 66 closes the water feeding valve.

Water fed from the outside during the water feeding valve is open is contained in the cup 63, and conveyed to the ice making space of the ice making tray 61.

Then, when the temperature of the ice making tray 61 detected by the temperature sensor 130 is lower than a preset temperature (for example, −7° C.), the control panel 66 determines that ice making is completed, and turns on the heater 64. When a predetermined period of time (for example, 2 minutes) elapses after the heater 64 is turned on, or when the temperature of the ice making tray 61 is above a second preset temperature (for example, −2° C.), the control panel 66 turns off the heater 64.

When the heater 64 is turned on, the ice making tray 61 has an increased temperature, and ice cubes I made in the ice making tray 61 start to melt at a contact portion between the ice cubes I and the ice making tray 61, and are separated from the ice making tray 61.

Meanwhile, while the supply of water, ice making, and on/off of the heater are progressed as described above, the nose 75*b* of the cam 75 continues to compress the protrusion 76*a* of the arm lever 76, the arm lever 76 is located at a position A' for providing a maximum separation between the magnet 101 and the hole-sensor 102, as shown in FIG. 7, and the detection lever 96 is raised to an original position A where the detection lever 96 does not detect the ice cubes I in the ice-cube container 110.

The control panel 66 drives the motor 68 after the heater 64 is turned off.

When the motor 68 is driven, the driving gear 70 and the driven gear 71 are rotated. Then, as shown in FIGS. 8 and 9, the cam 75 is rotated synchronously with the driven gear 71 in the counterclockwise direction, and the ejector 62 is rotated synchronously with the cam 75.

The pins 61 of the ejector 62 rotate in the ice making space, and scoop the ice cubes I onto the slider 61*a*. Then, the ice cubes I slide along the slider 61*a*, and fall into the ice-cube container 110.

Meanwhile, when the cam 75 is rotated in the counterclockwise direction, the protrusion 76*a* of the arm lever 76 is deviated from the nose 75*b* of the cam 75, and the arm lever 76 is rotated around the rotational joint 77 in the counterclockwise direction, as shown in FIGS. 8 and 9. At this time, the magnet 101 is moved from the position A' for providing the maximum separation between the magnet 101 and the hole-sensor 102 to a position C' for providing a minimum separation between the magnet 101 and the hole-sensor 102.

When the arm lever 76 is rotated in the counterclockwise direction, the detector driving gear 86 is rotated around the rotational joint 91 in the clockwise direction, while the detector driven gear 92 is rotated around the rotational joint 95 in the counterclockwise direction, as shown in FIGS. 8 and 9. In addition, the detection lever 96 is rotated synchronously with the detector driven gear 92 in the counterclockwise direction, and rotated downwardly from the original position A, as shown in FIG. 9.

When the detection lever 96 is rotated about 180 degrees to a position C for detecting complete filling with the ice cubes due to insufficient filling of the ice-cube container 110 with the ice cubes I, i.e., when the detection lever 96 is lowered as shown in FIG. 9, the arm lever 76 is rotated to the position C' for providing the minimum separation between the magnet 101 and the hole-sensor 102, as shown in FIG. 9. At this time, the hole-sensor 102 detects a magnetic field greater than or equal to a predetermined value resulting from approach of the magnet 101 to the hole-sensor 102, and the control panel 66 determines that the ice-cube container 110 is not completely filled with the ice cubes I.

When it is determined that the ice-cube container 110 is not completely filled with the ice cubes I, the control panel 66 repeats the supply of water, ice making, separation of the ice cubes, and detection of the complete filling with the ice cubes as described above.

On the contrary, when the detection lever 96 is not rotated to about 180 degrees, interfered with any of the ice cubes I, and is located at a position B above the position C due to complete filling of the ice-cube container 110 with the ice cubes I, the arm lever 76 stops at a position B' before the position C' for providing the minimum separation between the magnet 101 and the hole-sensor 102. At this time, the hole-sensor 102 detects a magnetic field lower than the predetermined value from the magnet 101, and the control panel 66 determines that the ice-cube container 110 is completely filled with the ice cubes I.

When it is determined that the ice-cube container 110 is completely filled with the ice cubes I, the control panel 66 stops the supply of water, ice making, separation of the ice cubes, and detection of complete filling with the ice cubes as described above, and thus the icemaker stops the operation of making the ice cubes.

Figure 10:
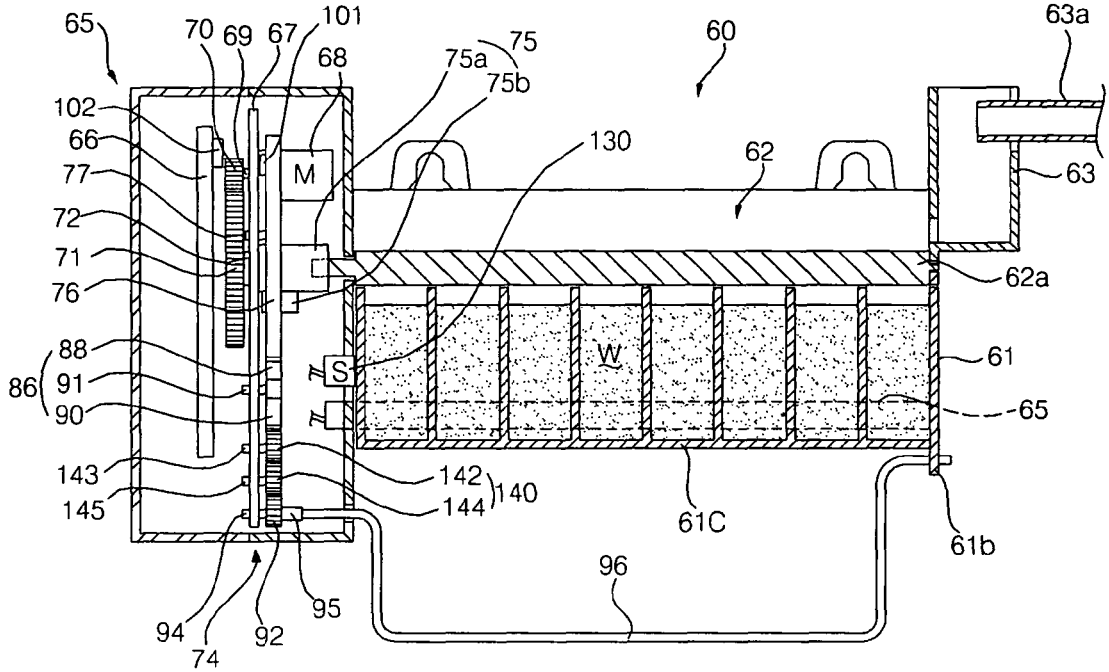
FIG. 10 is a partially cut-away cross-sectional view of an ice-cube complete filling detector in accordance with a second embodiment of the present invention.
Figure 11:
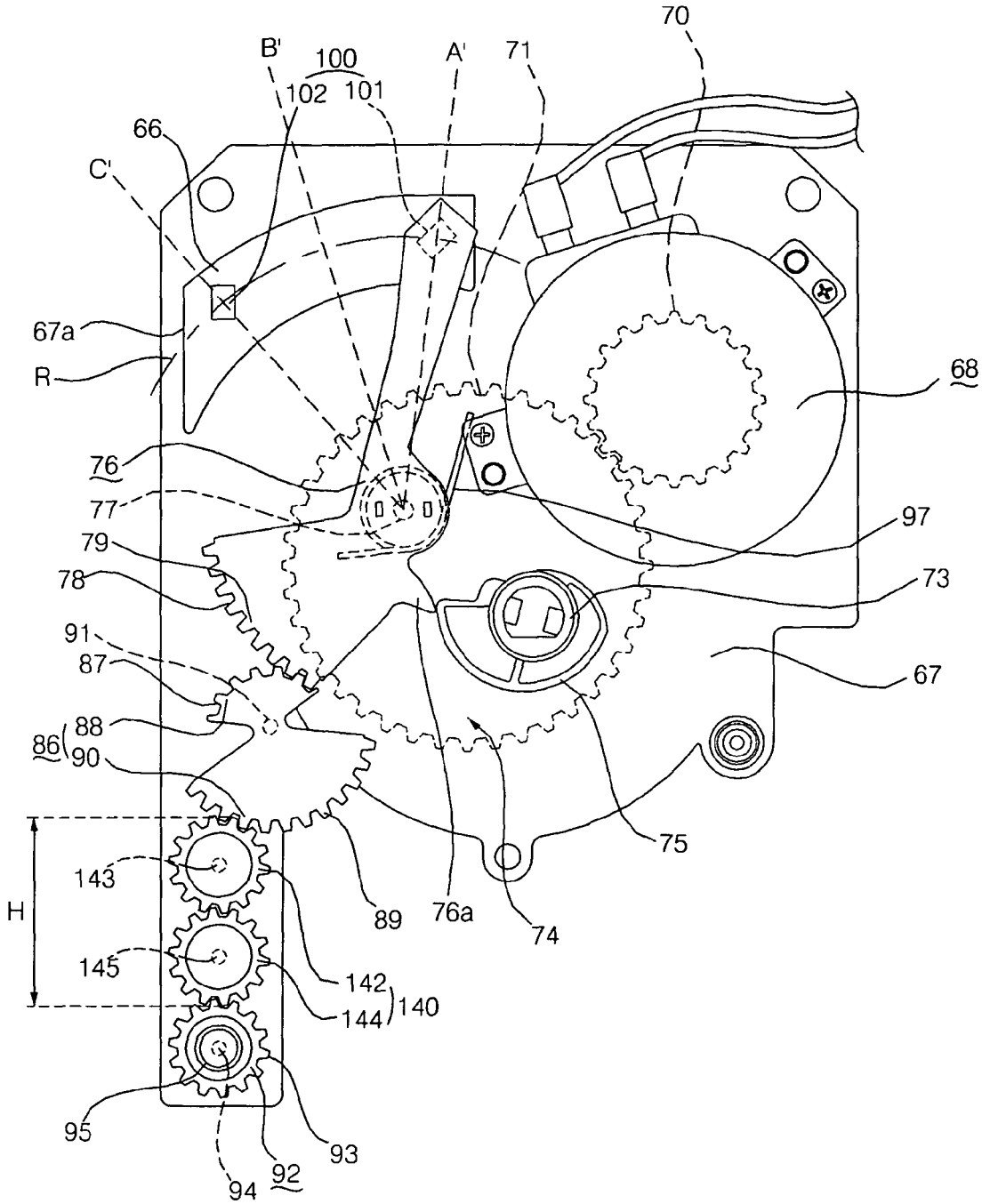
FIG. 11 is a side view of the ice-cube complete filling detector in accordance with the second embodiment before operation thereof.

FIG. 10 is a partially cut-away cross-sectional view of an ice-cube complete filling detector in accordance with a second embodiment of the invention, and FIG. 11 is a side view of the ice-cube complete filling detector in accordance with the second embodiment before operation thereof.

As shown in FIGS. 10 and 11, the ice-cube complete filling detector according to the second embodiment comprises a cam 75, an arm lever 76 rotated by the cam 75, a detector driving gear 86 rotated by the arm lever 76, a detector driven gear 92 connected to an ice-cube detection lever 96, a sensing unit 100 to detect rotation of one of the arm lever 76, the detector driving gear 86 and the detector driven gear 92, and a height adjusting unit 140 interlocked to the detector driving gear 86 to rotate the detector driven gear 92 while lowering the detector driven gear 92.

Since constructions and functions of the cam 75, the arm lever 76, the detector driving gear 86, the detector driven gear 92, the ice-cube detection lever 96, and the sensing unit 100 of the second embodiment are the same as those of the ice-cube complete filling detector of the first embodiment, these components are numbered as the same, and will not be described in detail hereinafter.

The detector driven gear 92 has a rotational joint 95, i.e. a rotational center thereof, located lower than a lower end 61*c* of an ice making space of the ice making tray 61.

The height adjusting unit 140 lowers a rotational center of the ice-cube detection lever 96, that is, an installation height of the detector driven gear 92, as much as possible. The height adjusting unit 140 is constituted by an intermediate gear assembly engaging with the detector driving gear 92 and the detector driven gear 92 to transfer a rotational force of the detector driving gear 86 to the detector driven gear 92.

The intermediate gear assembly 140 comprises two gears 142 and 144 which engage with each other between the detector driving gear 86 and the detector driven gear 92 while engaging with the detector driving gear 86 and the detector driven gear 92, respectively, such that, when the detector driving gear 86 is rotated in the clockwise direction as shown in FIG. 10, the detector driven gear 92 is rotated in the counterclockwise direction.

That is, the intermediate gear assembly 140 comprises an upper intermediate gear 142 which engages with the detector driving gear 86 and is rotated in the counterclockwise direction when the detector driving gear 86 is rotated in the clockwise direction, and a lower intermediate gear 144 which engages with the detector driven gear 92 and is rotated in the clockwise direction when the upper intermediate gear 142 is rotated in the counterclockwise direction, thereby rotating the detector driven gear 92 in the counterclockwise direction.

The upper and lower intermediate gears 142 and 144 have rotational joints 143 and 145 penetrating a plate 67 above the detector driven gear 92, respectively, such that they are rotatably supported by the plate 92.

In the ice-cube complete filling detector of the second embodiment, the detector driven gear 92 is lowered by a height H of the intermediate gear assembly 140, and the ice-cube detection lever 96 entirely lowers a height of a rotating range. Accordingly, in comparison to the first embodiment which does not comprise the intermediate gear assembly 140, the ice-cube complete filling detector of the second embodiment has a lower height to determine the complete filling state of the ice-cube container containing the ice cubes, thereby minimizing a possibility that the ice cubes I are vertically stacked on a wall of the ice-cube container.

Meanwhile, although the description was of comprising two intermediate gears in the second embodiment, the present invention is not limited to this construction. Rather, the number of intermediate gears can be three or more.

Advantageous effects of the present invention will be described hereinafter.

According to the present invention, the ice-cube complete filling detector and the refrigerator comprising the same comprise the detector driving gear rotated by the arm lever, the detector driven gear rotated by the detector driving gear, and the ice-cube detection lever connected to the detector driven gear, so that the detector driven gear is rotated via gear engagement by the detector driving gear and the detector driven gear, and the ice-cube detection lever can be rotated to about 180 degrees, thereby ensuring high accuracy of detection.

In addition, according to the present invention, the ice-cube complete filling detector and the refrigerator comprising the same comprise the detector driving gear rotated by the arm lever, the detector driven gear connected to the ice-cube detection lever, and the height adjusting unit interlocked to the detector driving gear to rotate the detector driven gear while lowering the detector driven gear, so that a height to determine the complete filling state of the ice-cube container containing the ice cubes is lowered without changing the length of the ice-cube detection lever, thereby minimizing errors in detection of the complete filling with the ice cubes, which can occur when the ice-cube container has a deep volume and the ice cubes are vertically stacked along the wall within the container.

It should be understood that the embodiments and the accompanying drawings have been described for illustrative purposes and the present invention is limited by the following claims. Further, those skilled in the art will appreciate that various modifications, additions and substitutions are allowed without departing from the scope and spirit of the invention according to the accompanying claims.

What is claimed is:

1. An ice-cube complete filling detector, comprising:

a cam;

an arm lever rotated by the cam;

a detector driving gear rotated by the arm lever;

a detector driven gear rotated by the detector driving gear;

an ice-cube detection lever connected to the detector driven gear; and a sensing unit to detect rotation of one of the arm lever, the detector driving gear and the ice-cube detection lever.

wherein the detector driving gear comprises an arm lever-engaging portion engaging with teeth of the arm lever, and a detector driven gear-engaging portion engaging with teeth of the detector driven gear.

2. The ice-cube complete filling detector according to claim 1, wherein the arm lever-engaging portion and the detector driven gear-engaging portion have sector shapes, respectively, and are opposite to each other with respect to a rotational center.

3. The ice-cube complete filling detector according to claim 1, wherein the detector driven gear-engaging portion is greater than the arm lever-engaging portion, and has more teeth than the arm lever-engaging portion.

4. A refrigerator, comprising:

a body comprising a containing compartment and a cooling cycle arrangement to supply cold air into the containing compartment;

a door to open or close the containing compartment;

an icemaker positioned in the door;

an ice-cube container positioned in the door to contain ice cubes separated from the icemaker;

an ice-cube discharger positioned in the door to allow the ice cubes to be taken from the ice-cube container;

a motor positioned in the icemaker;

a driving gear connected to the motor;

a driven gear rotated by the driving gear;

a cam connected to one of a rotational shaft of the driving gear and a rotational shaft of the driven gear;

an arm lever rotated by the cam;

a detector driving gear rotated by the arm lever;

a detector driven gear rotated by the detector driving gear;

an ice-cube detection lever connected to the detector driving gear; and a sensing unit to detect rotation of one of the arm lever, the detector driving gear and the ice-cube detection lever, wherein the detector driving gear comprises an arm lever-engaging portion engaging with teeth of the arm lever, and a detector driven gear-engaging portion engaging with teeth of the detector driven gear.

5. The ice-cube complete filling detector according to claim 4, wherein the detector driven gear has teeth formed along an outer periphery thereof.

6. The ice-cube complete filling detector according to claim 4, further comprising:

an intermediate gear assembly positioned between the detector driving gear and the detector driven gear to lower the detector driven gear.

* * * * *